US009090958B2

(12) United States Patent
Hartmann

(10) Patent No.: US 9,090,958 B2
(45) Date of Patent: Jul. 28, 2015

(54) CAST STEEL ALLOY AND CAST COMPONENT

(75) Inventor: Sylvia Hartmann, Schiffweiler (DE)

(73) Assignee: Eberspaecher Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 13/361,432

(22) Filed: Jan. 30, 2012

(65) Prior Publication Data

US 2012/0195785 A1 Aug. 2, 2012

(30) Foreign Application Priority Data

Jan. 31, 2011 (DE) ..... 10 2011 003 388

(51) Int. Cl.
*C22C 38/22* (2006.01)
*C22C 38/26* (2006.01)
*C22C 38/28* (2006.01)

(52) U.S. Cl.
CPC ..... *C22C 38/22* (2013.01); *C22C 38/26* (2013.01); *C22C 38/28* (2013.01)

(58) Field of Classification Search
USPC ..... 420/68, 69; 148/325
See application file for complete search history.

(56) References Cited

U.S. PATENT DOCUMENTS

2005/0217765 A1 * 10/2005 Inoue et al. ..... 148/325

FOREIGN PATENT DOCUMENTS

| | | | |
|---|---|---|---|
| JP | 60228616 | A | 11/1985 |
| JP | 05033105 | A | 2/1993 |
| JP | 05-0598498 | A | 3/1993 |
| JP | 5112848 | A | 5/1993 |
| JP | 09-279312 | * | 10/1997 |
| JP | 10-088285 | * | 4/1998 |
| JP | 10251808 | A | 9/1998 |
| JP | 2008195985 | A | 8/2008 |
| WO | WO 03/048402 | A1 | 6/2003 |

OTHER PUBLICATIONS

Machine-English translation of Japanese patent 10-088285, Kobyashi Yutaka et al., Apr. 7, 1998.*
S. Schuberth et al.; Tailored Strips—A Cost and Weight Saving Prospect for Automotive Exhaust Systems; 2008; 7 pages (661-667).

* cited by examiner

*Primary Examiner* — Deborah Yee
(74) *Attorney, Agent, or Firm* — Reinhart Boerner Van Deuren P.C.

(57) ABSTRACT

The present invention relates to a cast steel alloy for producing cast parts with ferritic structure, wherein the alloy contains iron (Fe), carbon (C), chromium (Cr) and molybdenum (Mo). An increased resistance to intercrystalline corrosion is obtained when the alloy additionally contains titanium (Ti) and niobium (Nb).

12 Claims, No Drawings

CAST STEEL ALLOY AND CAST COMPONENT

CROSS-REFERENCE TO RELATED PATENT APPLICATIONS

This patent application claims priority to German Application No. 102011003388.2, filed Jan. 31, 2011, the entire teachings and disclosure of which are incorporated herein by reference thereto.

FIELD OF THE INVENTION

The present invention relates to a ferritic cast steel alloy, i.e. a cast steel alloy for producing castings with ferritic structure. The present invention furthermore relates to an exhaust gas-conducting cast component of an exhaust system for a combustion engine, particularly of a motor vehicle, which is at least in sections produced from such a cast steel alloy.

BACKGROUND OF THE INVENTION

In the case of such an exhaust system of a combustion engine the individual components of the exhaust system are exposed to a comparatively high thermal load, so that as a rule only metallic materials, in particular steel alloys are used in order to produce such components of an exhaust system. These components are mainly gas-conducting pipes and housings for exhaust system treatment devices such as for example silencers, particle filters, catalytic converters. Parts of these components, such as for example flanges, can be castings, preferentially cast steel components.

In addition to this, the hot combustion gases create an aggressive environment which in particular in conjunction with water or steam leads to a comparatively high corrosion risk for the components or cast components. There is a particularly high corrosion risk in the case of an SCR-system, with which a comparatively aggressive reduction agent is employed. Usually, in the case of an SCR-system, a watery urea solution is fed to the exhaust gas flow, wherein the urea reacts into ammonia through hydrolysis, which in an SCR-catalytic converter is used for the reduction of nitrogen oxides. Such an ammonia-containing atmosphere is comparatively aggressive and increases the corrosion hazard for the components and cast components involved. Corrosion-resistant steel alloys, i.e. stainless steel alloys, are for example austenitic. Accordingly, it is usual in the case of exhaust systems to use austenitic cast steel alloys for producing cast components, i.e. cast steel alloys with which cast components having an austenitic structure can be produced. Austenite cast steel however is comparatively expensive, which is in particular due to the nickel content of austenitic cast steel alloys.

However, ferritic cast steel alloys also exist. However, these are not all resistant to intercrystalline corrosion. Such an intercrystalline corrosion occurs for example at temperatures between 300° C. and 700° C. in conjunction with a corresponding aggressive environment. The intercrystalline corrosion is due to the known ferritic cast steel alloys becoming sensitized in the mentioned temperature range (300° C. and 700° C.) so that chromium carbides form which precipitate on the grain boundaries and withdraw the chromium from the surroundings near the grain boundary. However, chromium is decisive for the corrosion resistance of the alloy in conventional ferritic cast steel alloys. This sensitization takes place either during the operation of the exhaust system at the operating temperatures usually prevailing there, which lie in the mentioned temperature window, or even during the welding of the individual cast components or components, when these for example pass through said temperature window during cooling-down following the welding operation. A further consequence of the sensitization is the so-called grain decay, as a result of which the cohesion of the material in the structure is disturbed.

A further disadvantage of known ferritic cast steel alloys is the formation of comparatively large grains in the structure, which likewise has a negative effect on the resistance to intercrystalline corrosion. In addition, strength disadvantages are incurred.

Ferritic cast steel alloys are clearly more economical than austenitic cast steel alloys, so that there is great interest within the scope or large series production, particularly during the manufacture of exhaust system for combustion engine, to produce the cast components or component employed—as far as possible—from ferritic cast steel alloys. However, this is not possible with the currently available ferritic cast steel alloys in many cases for the mentioned reasons.

The present invention deals with the problem of stating an embodiment for a cast steel alloy, wherein the hazard of intercrystalline corrosion even at higher temperature loading is reduced, which for example occurs on the castings produced from it during joining, particularly during welding, and/or during operation of an exhaust system.

SUMMARY OF THE INVENTION

According to the invention, this problem is solved through the subject of the independent claim. Advantageous embodiments are the subject of the dependent claims.

DETAILED DESCRIPTION OF THE INVENTION

The invention is based on the general idea of adding or including as alloy titanium (Ti) and niobium (Nb) to a cast steel alloy creating a ferritic structure and containing iron (Fe), carbon (C), chromium (Cr) and molybdenum (Mo). Through the addition as alloy of titanium and niobium the cast steel alloy is stabilised. The targeted stabilisation of the cast steel alloy with titanium and niobium proposed according to the invention results in that the structure is subjected to a grain refining, so that smaller grain sizes thus occur and that the cast steel alloy has a comparatively high and lasting resistance to intercrystalline corrosion even in the relevant critical temperature range from approximately 300° C. to approximately 600° C. or approximately 700° C. It has been shown that such a cast steel alloy is not sensitized even through the usual welding processes and in particular is not sensitized in the usual temperatures to be expected with exhaust system either (300° C. to 600° C. or 700° C.). Thus, an extremely high corrosion resistant even to intercrystalline corrosion is achieved. At the same time, the cast steel alloy remains cost-effective compared with an austenitic material.

The cast steel alloy is a ferritic cast steel alloy, i.e. resulting in cast components with ferritic structure.

According to a particularly advantageous embodiment the cast steel alloy is configured free of nickel. This means that the cast steel alloy, except for parasitic effects, which can result through unavoidable contaminations, does not contain any nickel. Because of this, the cast steel alloy introduced here becomes particularly cost-effective compared with austenite materials containing nickel.

It has proved advantageous when the component of carbon (C) in the alloy is at a maximum of 0.05 percent by weight.

In addition or alternatively it is advantageous when the component of chromium (Cr) in the alloy is within a range of and including 17 percent by weight to and including 25 percent by weight.

In addition or alternatively is it practical when the component of molybdenum (Mo) in the alloy is within a range of and including 1 percent by weight to including 3 percent by weight.

It is particularly advantageous furthermore when the component of titanium (Ti) in the alloy is a maximum of 1 percent by weight.

In addition or alternatively it is advantageous when the component of niobium (Nb) in the alloy amounts to a maximum of 1 percent by weight.

Particularly advantageous here is an accumulated realization of the above advantageous embodiments. In this case, the alloy contains a component of carbon (C) of a maximum of 0.05 percent by weight and a component of chromium (Cr) of and including 17 percent by weight to and including 25 percent by weight and a component of molybdenum (Mo) of and including 1 percent by weight to and including 3 percent by weight and a component of titanium (Ti) of a maximum of 1 percent by weight and a component of niobium (Nb) of a maximum of 1 percent by weight.

It has proved to be particularly advantageous furthermore for the intercrystalline corrosion resistance when the weight components of carbon, titanium and niobium are matched to one another such that the component of carbon in percent by weight divided by the sum from the product of 0.25 with the component of titanium in percent by weight and the product from 0.14 with the component of niobium in percent by weight is greater than 3. In other words, for realizing this special embodiment the following formula or relationship has to be maintained:

$$\% C/(0.25x\% Ti+0.14x\% Nb)>3.$$

Within this relationship or equation, "%" represents the term "percent by weight".

In addition to iron, carbon, chromium, molybdenum, titanium and niobium the cast steel alloy introduced here can also contain the following elements, wherein any combinations can be realized:

silicon (Si), in particular with a component of a maximum of 1.00 percent by weight, and/or manganese (Mn), in particular with a component of a maximum 1.00 percent by weight, phosphorous (P), in particular with a component of a maximum of 0.040 percent by weight, sulphur (S), in particular with a component of a maximum of 0.015 percent by weight and/or nitrogen (N), in particular with a component of a maximum of 0.040 percent by weight.

Here, too, an accumulated realization of the preferred embodiments described above is conceivable, so that the alloy in this case contains a maximum of 1.00 percent by weight of silicon and a maximum of 1.00 percent by weight of manganese and a maximum of 0.040 percent by weight of phosphorous and a maximum of 0.015 percent by weight of sulphur and a maximum of 0.040 percent by weight of nitrogen.

According to a particularly advantageous embodiment, the cast steel alloy introduced here thus has the following composition:

carbon (C) with a component of a maximum of 0.05% by weight, silicon (Si) with a component of a maximum of 1.00% by weight, manganese (Mn) with a component of a maximum of 1.00% by weight, phosphorous with a component of a maximum of 0.040% by weight, sulphur with a component of a maximum of 0.015% by weight, nitrogen (N) with a component of a maximum of 0.040% by weight, chromium (Cr) with a component of and including 17% by weight to and including 25% by weight, molybdenum (Mo) with a component of and including 1% by weight to and including 3% by weight, niobium (Nb) with a component of at least 0.001% by weight to a maximum of 1% by weight, titanium (Ti) with a component of at least 0.001% by weight to a maximum of 1% by weight, iron (Fe) for the remainder up to 100% by weight, wherein % by weight stands for percent by weight.

The present invention also relates to a cast component, particularly an exhaust gas-conducting cast component, of an exhaust system for a combustion engine, in particular of a motor vehicle. Here, the cast component can form a part, e.g. a connecting flange, of a component, e.g. of a housing, of such an exhaust system. Here, said cast component is completely or at least partially produced from the cast steel alloy introduced here. At least the region of the respective cast component directly exposed to the exhaust gas is practically produced from the cast steel alloy introduced here.

Cast components or components can for example be exhaust pipes or housings of exhaust gas treatment devices. The cast component can also be a flow guiding element such as for example a funnel, a pipe, a flange or the like.

The invention claimed is:

1. A ferritic cast steel alloy, comprising: iron (Fe), carbon (C), chromium (Cr) and molybdenum (Mo), and wherein the alloy additionally contains titanium (Ti) and niobium (Nb), wherein the alloy is free of nickel; and wherein the weight components of carbon (C), titanium (Ti) and niobium (Nb) are matched to one another such that the following applies: % C/(0.25x % Ti+0.14x % Nb)>3, wherein % for stands for percent by weight.

2. The cast steel alloy according to claim 1, wherein the alloy contains:

a component of carbon (C) of a maximum 0.05 percent by weight, a component of chromium (Cr) of and including 17 percent by weight to and including 25 percent by weight, a component of molybdenum (Mo) of and including 1 percent by weight to and including 3 percent by weight, a component of titanium (Ti) of a maximum of 1 percent by weight and a component of niobium (Nb) of a maximum of 1 percent by weight.

3. The cast steel alloy according to claim 1, wherein the alloy contains:

at least one of: a component of carbon (C) of a maximum of 0.05 percent by weight, and a component of chromium (Cr) of and including 17 percent by weight to and including 25 percent by weight, a component of molybdenum (Mo) of and including 1 percent by weight to and including 3 percent by weight, a component of titanium (Ti) of a maximum of 1 percent by weight, and a component of niobium (Nb) of a maximum of 1 percent by weight.

4. The cast steel alloy according to claim 1, wherein the alloy additionally contains at least one of:

silicon (Si), with a component of a maximum of 1.00 percent by weight;

manganese (Mn), with a component of a maximum of 1.00 percent by weight;

phosphorous (P), with a component of a maximum of 0.040 percent by weight;

sulphur (S), with a component of a maximum of 0.015 percent by weight; and nitrogen (N), with a component of a maximum of 0.040 percent by weight.

5. The cast steel alloy according to claim 1, wherein the alloy additionally contains:

a component of silicon (Si) of a maximum of 1.00 percent by weight, a component of manganese (Mn) of 1.00 percent by weight, a component of phosphorous (P) of a maximum of 0.040 percent by weight, a component of sulphur of a maximum of 0.015 percent by weight, a component of nitrogen (N) of 0.040 percent by weight.

6. A cast component of an exhaust system for a combustion engine of a motor vehicle, produced from a cast steel alloy according to claim 1.

7. A component of an exhaust system for a combustion engine of a motor vehicle, with at least one constituent part that is configured as cast component, which is produced from a cast steel alloy according to claim 1.

8. A method for forming a cast component of an exhaust system for a combustion engine of a motor vehicle, which comprises casting the component utilizing an alloy as claimed in claim 1.

9. The method of claim 8, wherein the alloy utilized for casting the component contains:

a component of carbon (C) of a maximum 0.05 percent by weight, a component of chromium (Cr) of and including 17 percent by weight to and including 25 percent by weight, a component of molybdenum (Mo) of and including 1 percent by weight to and including 3 percent by weight, a component of titanium (Ti) of a maximum of 1 percent by weight and a component of niobium (Nb) of a maximum of 1 percent by weight.

10. The method of claim 8, wherein the alloy utilized for casting the component contains at least one of: a component of carbon (C) of a maximum of 0.05 percent by weight, and a component of chromium (Cr) of and including 17 percent by weight to and including 25 percent by weight, a component of molybdenum (Mo) of and including 1 percent by weight to and including 3 percent by weight, a component of titanium (Ti) of a maximum of 1 percent by weight, and a component of niobium (Nb) of a maximum of 1 percent by weight.

11. The method of claim 8, wherein the alloy utilized for casting the component additionally contains at least one of:

silicon (Si), with a component of a maximum of 1.00 percent by weight;

manganese (Mn), with a component of a maximum of 1.00 percent by weight;

phosphorous (P), with a component of a maximum of 0.040 percent by weight;

sulphur (S), with a component of a maximum of 0.015 percent by weight; and nitrogen (N), with a component of a maximum of 0.040 percent by weight.

12. The method of claim 8, wherein the alloy utilized for casting the component additionally contains at least one of:

a component of silicon (Si) of a maximum of 1.00 percent by weight, a component of manganese (Mn) of 1.00 percent by weight, a component of phosphorous (P) of a maximum of 0.040 percent by weight, a component of sulphur of a maximum of 0.015 percent by weight, a component of nitrogen (N) of 0.040 percent by weight.

* * * * *